US011693339B2

(12) United States Patent
Ono et al.

(10) Patent No.: US 11,693,339 B2
(45) Date of Patent: Jul. 4, 2023

(54) UNIT AND IMAGE FORMING APPARATUS HAVING A CERTAIN ADHESIVE FORCE PROPERTY

(71) Applicant: FUJIFILM Business Innovation Corp., Tokyo (JP)

(72) Inventors: Masato Ono, Ebina (JP); Masayuki Seko, Ebina (JP); Tomoaki Tanaka, Minamiashigara (JP); Yukiaki Nakamura, Minamiashigara (JP); Ryutaro Kembo, Minamiashigara (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/397,232

(22) Filed: Aug. 9, 2021

(65) Prior Publication Data

US 2022/0244663 A1 Aug. 4, 2022

(30) Foreign Application Priority Data

Feb. 2, 2021 (JP) ..... 2021-015150

(51) Int. Cl.
*G03G 15/16* (2006.01)
*G03G 15/00* (2006.01)

(52) U.S. Cl.
CPC ..... *G03G 15/1605* (2013.01); *G03G 15/162* (2013.01); *G03G 15/6585* (2013.01)

(58) Field of Classification Search
CPC ..... G03G 15/1605
See application file for complete search history.

(56) References Cited

U.S. PATENT DOCUMENTS 5,761,594 A 6/1998 Seto et al.
8,929,785 B1 * 1/2015 Roetker ..... G03G 15/162 399/302

(Continued)

FOREIGN PATENT DOCUMENTS

JP 2011-118192 A 6/2011
JP 2015-227988 A 12/2015
JP 2017-62413 A 3/2017

OTHER PUBLICATIONS

Communication dated Feb. 4, 2022 issued by the European Patent Office in counterpart European Application No. 21190042.8.

*Primary Examiner* — Arlene Heredia
(74) *Attorney, Agent, or Firm* — Sughrue Mion, PLLC

(57) ABSTRACT

A unit includes: a developing device configured to develop an electrostatic charge image that is formed on a surface of an image carrier, as a toner image with a developer including a flat toner containing a flat pigment, the developer being accommodated in the developing device; and a transfer device including an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium, wherein the intermediate transfer belt contains a resin and conductive carbon particles, and after the flat toner adheres to an outer circumferential surface of the intermediate transfer belt in a loading amount of 3 g/cm$^2$, in a case where air is blown to the outer circumferential surface from an upper side of the outer circumferential surface while increasing a blowing pressure, all the flat toner adhering to the outer (Continued)

Figure 1:
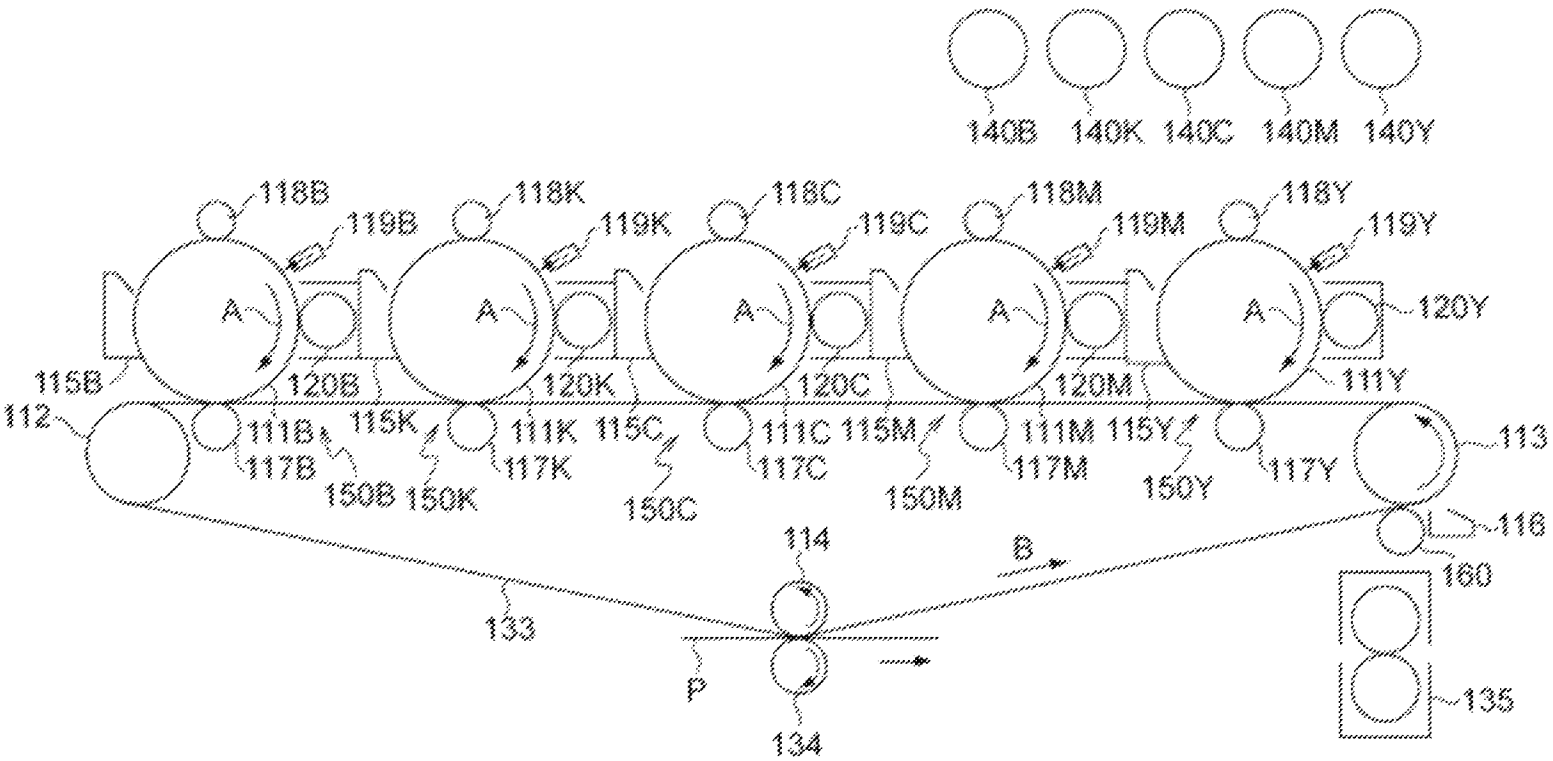

circumferential surface is separated from the outer circumferential surface at a blowing pressure of 25 kPa or less.

14 Claims, 2 Drawing Sheets

(56) References Cited

U.S. PATENT DOCUMENTS

| | | | |
|---|---|---|---|
| 2012/0193583 | A1 | 8/2012 | Roetker et al. |
| 2017/0090318 | A1 | 3/2017 | Sugitate et al. |
| 2019/0094787 | A1 | 3/2019 | Anno et al. |

* cited by examiner

UNIT AND IMAGE FORMING APPARATUS HAVING A CERTAIN ADHESIVE FORCE PROPERTY

CROSS-REFERENCE TO RELATED APPLICATIONS

This application is based on and claims priority under 35 USC 119 from Japanese Patent Application No. 2021-015150 filed on Feb. 2, 2021.

BACKGROUND

Technical Field

The present disclosure relates to a unit and an image forming apparatus.

Related Art

In an image forming apparatus (a copying machine, a facsimile machine, a printer, or the like) using an electrophotographic process, a toner image formed on a surface of an image carrier is transferred onto a surface of a recording medium and fixed on the recording medium to form an image.

In recent years, the use of a brilliant toner containing a brilliant pigment has been studied for the purpose of forming an image having brilliance such as metallic luster.

For example, JP-A-2017-062413 discloses "a brilliant toner containing a brilliant pigment, an organic pigment, a binder resin, a releasing agent, and an external additive, in which a content of a toluene-insoluble component other than the brilliant pigment and the external additive is 8 mass % or more and 40 mass % or less".

SUMMARY

Since the brilliant pigment is a pigment having a flake shape, the toner also has a flake shape. In a transfer device using an intermediate transfer belt, when a toner image formed of a flat toner containing a flat pigment is transferred onto a recording medium by the intermediate transfer belt, transfer failure may occur.

Aspects of non-limiting embodiments of the present disclosure relate to a unit that can prevent a transfer failure of a toner image formed of flat toner as compared with a case of including an intermediate transfer belt which includes a resin and conductive carbon particles and in which after flat toner adheres to an outer circumferential surface, when air is blown to the outer circumferential surface from an upper side of the outer circumferential surface while increasing a blowing pressure, all the flat toner adhering to the outer circumferential surface remains on the outer circumferential surface even if the blowing pressure is more than 25 kPa.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a unit including:

a developing device configured to develop an electrostatic charge image that is formed on a surface of an image carrier, as a toner image with a developer including a flat toner containing a flat pigment, the developer being accommodated in the developing device; and a transfer device that includes an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium, in which the intermediate transfer belt contains a resin and conductive carbon particles, and after the flat toner adheres to an outer circumferential surface of the intermediate transfer belt in a loading amount of 3 g/cm$^2$, in a case where air is blown to the outer circumferential surface from an upper side of the outer circumferential surface while increasing a blowing pressure, all the flat toner adhering to the outer circumferential surface is separated from the outer circumferential surface at a blowing pressure of 25 kPa or less.

BRIEF DESCRIPTIONS OF THE DRAWINGS

Figure 2:
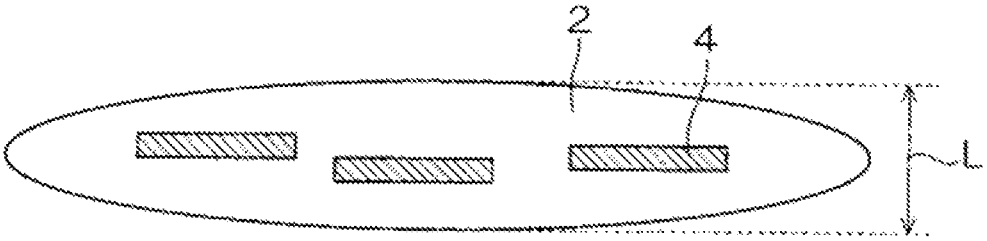

Exemplary embodiment(s) of the present invention will be described in detail based on the following figures, wherein:

FIG. 1 is a schematic configuration diagram showing an example of an image forming apparatus according to the present exemplary embodiment; and FIG. 2 is a cross-sectional view schematically showing an example of flat toner.

DETAILED DESCRIPTION

Hereinafter, the present exemplary embodiment which is an example of the present disclosure will be described. These descriptions and Examples are merely examples of the exemplary embodiment, and do not limit the scope of the present disclosure.

In the numerical range described in stages in the present exemplary embodiment, an upper limit or a lower limit described in one numerical range may be replaced with an upper limit or a lower limit of the numerical range described in other stages. In addition, in the numerical range described in the present exemplary embodiment, the upper limit or the lower limit of the numerical range may be replaced with values shown in Examples.

In the present exemplary embodiment, the term "step" indicates not only an independent step, and even when a step cannot be clearly distinguished from other steps, this step is included in the term "step" as long as the intended purpose of the step is achieved.

In the present exemplary embodiment, when an exemplary embodiment is described with reference to the drawings, the configuration of the exemplary embodiment is not limited to the configuration shown in the drawings. In addition, the sizes of the members in each drawing are conceptual, and the relative size relationship between the members is not limited to the relative size relationship between the members shown in the drawings.

In the present exemplary embodiment, each component may include plural corresponding substances. In the present exemplary embodiment, in a case of referring to the amount of each component in the composition, when there are plural substances corresponding to each component in the composition, unless otherwise specified, it refers to the total amount of the plural substances present in the composition.

[Unit]

A unit according to the exemplary embodiment includes: a developing device configured to develop an electrostatic charge image that is formed on a surface of an image carrier, as a toner image with a developer including a flat toner containing a flat pigment, the developer being accommodated in the developing device; and a transfer device that includes an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium.

As the intermediate transfer belt, there is applied an intermediate transfer belt containing a resin and conductive carbon particles, in which after the flat toner adheres to an outer circumferential surface of the intermediate transfer belt in a loading amount of 3 g/cm$^2$, in a case where air is blown to the outer circumferential surface from an upper side of the outer circumferential surface while increasing a blowing pressure, all the flat toner adhering to the outer circumferential surface is separated from the outer circumferential surface at a blowing pressure of 25 kPa or less.

Hereinafter, the "property in which the flat toner adhering to an outer circumferential surface of an intermediate transfer belt is separated from the outer circumferential surface at a blowing pressure of 25 kPa or less" is also referred to as an "adhesive force property".

In the unit according to the present exemplary embodiment, the transfer failure of the toner image formed of the flat toner is prevented by the above-described configuration. The reason is not clear, but is presumed as follows.

In an image forming apparatus using an intermediate transfer belt, when flat toner is used as the toner, and a toner image is transferred from the intermediate transfer belt to a recording medium, transfer failure of the toner image may occur. This is because the flat toner is considered to have a larger contact area with an outer circumferential surface of the intermediate transfer belt and an increased adhesive force, compared with a normal spherical toner.

In contrast, an endless belt satisfying adhesive force properties is applied as the intermediate transfer belt in the unit according to the present exemplary embodiment. That is, as the intermediate transfer belt, an endless belt in which a non-electrostatic adhesive force of the outer circumferential surface itself is reduced is applied. As a result, the non-electrostatic adhesive force generated between the outer circumferential surface of the intermediate transfer belt and the flat toner is reduced. Therefore, even in the case of a toner image formed of flat toner, the transferability may be improved.

As described above, in the unit according to the present exemplary embodiment, the transfer failure of the toner image formed of the flat toner may be prevented.

[Image Forming Apparatus]

Hereinafter, an image forming apparatus including the unit according to the present exemplary embodiment will be described.

The image forming apparatus according to the present exemplary embodiment includes: a toner image forming device that includes an image carrier and a developing device of the unit according to the above present exemplary embodiment, and forms a toner image on a surface of the image carrier; and a transfer device of the unit according to the above present exemplary embodiment, which is a transfer device that transfers the toner image formed on the surface of the image carrier to a surface of the recording medium.

In other words, the image forming apparatus according to the present exemplary embodiment includes: a toner image forming device that includes an image carrier, and a developing device configured to develop an electrostatic charge image that is formed on a surface of the image carrier, as a toner image with a developer including a flat toner containing a flat pigment, the developer being accommodated in the developing device; and a transfer device that includes an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium, in which the intermediate transfer belt contains a resin and conductive carbon particles, and after the flat toner adheres to an outer circumferential surface of the intermediate transfer belt in a loading amount of 3 g/cm$^2$, in a case where air is blown to the outer circumferential surface from an upper side of the outer circumferential surface while increasing a blowing pressure, all the flat toner adhering to the outer circumferential surface is separated from the outer circumferential surface at a blowing pressure of 25 kPa or less.

Examples of the toner image forming device include a device including an image carrier, a charging device that charges a surface of the image carrier, an electrostatic charge image forming device that forms an electrostatic charge image on the charged surface of the image carrier, and a developing device that develops the electrostatic charge image formed on the surface of the image carrier with a developer containing flat toner to form a toner image.

As the image forming apparatus according to the present exemplary embodiment, a known image forming apparatus is applied. Examples of the known image forming apparatus include an apparatus including a fixing device that fixes a toner image which is transferred to a surface of a recording medium; an apparatus including a cleaning device that cleans a surface of an image carrier after transfer of a toner image and before charging; an apparatus including an static eliminator that eliminates charges by irradiating a surface of an image carrier with static elimination light after transfer of a toner image and before charging; and an apparatus including an image carrier heating member for increasing a temperature of an image carrier and lowering a relative temperature.

Hereinafter, an example of the image forming apparatus according to the present exemplary embodiment will be described, but the invention is not limited thereto. In the following description, the parts shown in the drawings will be described, and description of the other parts will be omitted.

In the following description, "silver toner" means the flat toner.

FIG. 1 is a schematic configuration diagram showing an example of an image forming apparatus of the present exemplary embodiment, and is a diagram showing an image forming apparatus of a five-tandem type and an intermediate transfer type.

The image forming apparatus shown in FIG. 1 includes first to fifth electrophotographic image forming units 150Y, 150M, 150C, 150K, and 150B (an example of a toner image forming device) that output images of respective colors of yellow (Y), magenta (M), cyan (C), black (K), and silver (B) based on image data subjected to color separation. The image forming units 150Y, 150M, 150C, 150K, and 150B are arranged side by side at predetermined intervals in the horizontal direction. The image forming units 150Y, 150M, 150C, 150K, and 150B may be process cartridges that are attached to and detached from the image forming apparatus.

In FIG. 1, reference numerals 111Y, HIM, 111C, 111K, and 111B denote photoconductors, reference numerals 115Y, 115M, 115C, 115K, and 115B denote cleaning devices, reference numerals 118Y, 118M, 118C, 118K, and 118B denote charging rollers, and reference numerals 119Y, 119M, 119C, 119K, and 119B denote exposure devices.

An intermediate transfer belt 133 extends below the image forming units 150Y, 150M, 150C, 150K, and 150B through the image forming units 150Y, 150M, 150C, 150K, and 150B. The intermediate transfer belt 133 is wound around a driving roller 113, a support roller 112, and an opposing roller 114, which are in contact with an inner surface of the intermediate transfer belt 133, and runs in a direction from the first image forming unit 150Y toward the fifth image forming unit 150B (that is, the direction of an arrow B in FIG. 1). An intermediate transfer belt cleaning device 116 is provided on an image carrying surface side of the intermediate transfer belt 133 in a manner of facing the driving roller 113. On an upstream side of the intermediate transfer belt cleaning device 116 in the rotation direction of the intermediate transfer belt 133, a voltage applying device 160 is provided to generate an electric field between the voltage applying device 160 and the intermediate transfer belt 133 by generating a potential difference between the voltage applying device 160 and the support roller 113.

Developing devices (examples of developing devices) 120Y, 120M, 120C, 120K, and 120B of the image forming units 150Y, 150M, 150C, 150K, and 150B are supplied with yellow, magenta, cyan, black, and silver toners stored in toner cartridges 140Y, 140M, 140C, 140K, and 140B, respectively.

Since the first to fifth image forming units 150Y, 150M, 150C, 150K, and 150B have the same configuration, operation, and function, here, the first image forming unit 150Y, which is arranged on the upstream side in the running direction of the intermediate transfer belt and forms a yellow image, will be described as a representative.

The first image forming unit 150Y includes a photoreceptor 111Y functioning as an image carrier. Around the photoreceptor 111Y, the following members are disposed in order: a charging roller (an example of a charging device) 118Y that charges a surface of the photoreceptor 111Y to a predetermined potential, an exposure device (an example of an electrostatic charge image forming device) 119Y that forms an electrostatic charge image by exposing the charged surface with a laser beam based on an image signal subjected to color separation, a developing device (an example of a developing device) 120Y that develops the electrostatic charge image by supplying a toner to the electrostatic charge image, a primary transfer roller (an example of a primary transfer device) 117Y that transfers the developed toner image onto the intermediate transfer belt 133, and a photoreceptor cleaning device (an example of a cleaning device) 115Y that removes the toner remaining on the surface of the photoreceptor 111Y after the primary transfer.

The primary transfer roller 117Y is disposed inside the intermediate transfer belt 133 and is provided at a position facing the photoreceptor 111Y. A bias power source (not shown) for applying a primary transfer bias is connected to each of the primary transfer rollers 117Y, 117M, 117C, 117K, and 117B of the respective image forming units. Each bias power source changes the value of the transfer bias applied to each primary transfer roller under the control of a controller (not shown).

Hereinafter, the operation of forming a yellow image in the first image forming unit 150Y will be described.

First, prior to the operation, the surface of the photoreceptor 111Y is charged to a potential of −600 V to −800 V by the charging roller 118Y.

The photoreceptor 111Y is formed by laminating a photoconductive layer on a conductive substrate (for example, having volume resistivity of $1\times10^{-6}$ Ω·cm or less at 20° C.). The photoconductive layer usually has high resistance (corresponding to resistance of a general resin), but, when irradiated with a laser beam, the specific resistance of a portion irradiated with the laser beam changes. Therefore, the charged surface of the photoreceptor 111Y is irradiated with a laser beam from the exposure device 119Y in accordance with yellow image data sent from the controller (not shown). As a result, an electrostatic charge image having a yellow image pattern is formed on the surface of the photoreceptor 111Y.

The electrostatic charge image is an image formed on the surface of the photoreceptor 111Y by charging, and is a so-called negative latent image formed by lowering the specific resistance of the portion of the photoconductive layer irradiated with the laser beam from the exposure device 119Y to flow a charge charged on the surface of the photoreceptor 111Y and by, on the other hand, leaving a charge of a portion not irradiated with the laser beam.

The electrostatic charge image formed on the photoreceptor 111Y rotates to a predetermined developing position as the photoreceptor 111Y runs. Then, at this developing position, the electrostatic charge image on the photoreceptor 111Y is developed and visualized as a toner image by the developing device 120Y.

In the developing device 120Y, for example, a developer containing at least a yellow toner and a carrier is accommodated. The yellow toner is triboelectrically charged by being stirred inside the developing device 120Y, and has a charge of the same polarity (specifically, negative polarity) as the charge charged on the photoreceptor 111Y and is carried on a developer roller (an example of a developer carrier). Then, when the surface of the photoreceptor 111Y passes through the developing device 120Y, the yellow toner electrostatically adheres to a discharged latent image portion on the surface of the photoreceptor 111Y, and the latent image is developed by the yellow toner. The photoreceptor 111Y on which the yellow toner image is formed continuously runs at a predetermined speed, and the toner image developed on the photoreceptor 111Y is conveyed to a predetermined primary transfer position.

When the yellow toner image on the photoreceptor 111Y is conveyed to the primary transfer position, a primary transfer bias is applied to the primary transfer roller 117Y, an electrostatic force from the photoreceptor 111Y to the primary transfer roller 117Y acts on the toner image, and the toner image on the photoreceptor 111Y is transferred onto the intermediate transfer belt 133. The transfer bias applied at this time has a polarity (+) opposite to the polarity (−) of the toner, and is controlled to, for example, +10 μA by the controller (not shown) in the first image forming unit 150Y.

On the other hand, the toner remaining on the photoreceptor 111Y is removed and collected by the photoreceptor cleaning device 115Y.

The primary transfer biases applied to the primary transfer rollers 117M, 117C, 117K, and 117B of the second image forming unit 150M and the subsequent units are also controlled in the same manner as in the first image forming unit 150Y.

In this way, the intermediate transfer belt 133 onto which the yellow toner image is transferred by the first image forming unit 150Y is sequentially conveyed through the second to fifth image forming units 150M, 150C, 150K, and 150B, and the toner images of the respective colors are superimposed and transferred in a multiple manner.

The intermediate transfer belt 133 onto which the toner images of five colors are transferred in a multiple manner through the first to fifth image forming units arrives at a secondary transfer unit including the intermediate transfer belt 133, the opposing roller 114 in contact with an inner surface of the intermediate transfer belt, and a secondary transfer roller (an example of a secondary transfer device) 134 disposed on the image carrying surface side of the intermediate transfer belt 133. On the other hand, a recording sheet (an example of a recording medium) P is fed to a gap between the secondary transfer roller 134 and the intermediate transfer belt 133 via a supply mechanism at a predetermined timing, and a secondary transfer bias is applied to the opposing roller 114. The transfer bias applied at this time has the same polarity (−) as the polarity (−) of the toner. The electrostatic force from the intermediate transfer belt 133 to the recording paper P acts on the toner image, and the toner image on the intermediate transfer belt 133 is transferred onto the recording sheet P. The secondary transfer bias at this time is determined according to a resistance detected by a resistance detecting device (not shown) that detects the resistance of the secondary transfer unit, and is subjected to voltage control.

Thereafter, the recording sheet P is sent to a pressure contact portion (so-called nip portion) of a pair of fixing rollers in a fixing device (an example of a fixing device) 135, and the toner image is fixed onto the recording sheet P, thereby forming a fixed image.

Examples of the recording sheet P onto which the toner image is transferred include plain paper used in electrophotographic copiers and printers. As the recording medium, in addition to the recording sheet P, an OHP sheet or the like may be used.

In order to further improve the smoothness of the image surface after fixing, the surface of the recording sheet P is also preferably smooth. For example, coated paper obtained by coating the surface of plain paper with a resin or the like, art paper for printing, or the like is preferably used.

The recording sheet P on which the fixing of the color image is completed is conveyed out toward a discharge unit, and a series of the color image forming operations is completed.

Here, the developing device 120B of the image forming unit 150B corresponds to an example of the developing device in the unit according to the above present exemplary embodiment.

A device including the intermediate transfer belt 133, the primary transfer roller 117B, and the secondary transfer roller 134 corresponds to an example of the transfer device in the unit according to the above present exemplary embodiment.

A device, which includes the developing device 120B and a transfer device including the intermediate transfer belt 133, the primary transfer roller 117B, and the secondary transfer roller 134, corresponds to an example of the unit according to the above present exemplary embodiment.

The image forming apparatus shown in FIG. 1 is an image forming apparatus having a configuration in which the toner cartridges 140Y, 140M, 140C, 140K, and 140B are attached and detached, and the developing devices 120Y, 120M, 120C, 120K, and 120B are connected to toner cartridges corresponding to the respective developing devices (colors) by toner supply pipes (not shown). When the amount of toner accommodated in the toner cartridge decreases, the toner cartridge is replaced.

Hereinafter, the developing device and the transfer device of the unit and the image forming apparatus according to the present exemplary embodiment will be described in more detail. In the following description, the reference numerals are omitted.

—Developing Device—

Hereinafter, the developing device will be described.

The developing device is provided, for example, on the downstream side in the rotation direction of the image carrier from the light irradiation position of the electrostatic charge image forming device. In the developing device, an accommodating unit for accommodating the developer is provided. In the accommodating unit, the developer including the flat toner containing the flat pigment is accommodated. The flat toner is accommodated, for example, in a charged state in the developing device. Details of the flat toner will be described later.

The developing device 18 includes, for example, a developing member that develops an electrostatic charge image formed on a surface of the image carrier with a developer containing flat toner, and a power source that applies a developing voltage to the developing member. The developing member is electrically connected to, for example, a power source.

The developing member of the developing device is selected according to the type of the developer, and examples of the developing member include a developing roller including a developing sleeve with built-in magnet.

In the developing device (including a power source), for example, a developing voltage is applied to the developing member. The developing member to which the developing voltage is applied is charged to a developing potential corresponding to the developing voltage. The developing member charged to the developing potential holds, for example, the developer accommodated in the developing device on the surface thereof, and supplies the flat toner contained in the developer from the developing device to the surface of the image carrier.

The toner supplied onto the image carrier adheres to, for example, an electrostatic charge image on the image carrier by the electrostatic force. Specifically, for example, by the potential difference in a region where the image carrier and the developing member face each other, that is, the potential difference between the potential of the surface of the image carrier in the region and the developing potential of the developing member, the flat toner contained in the developer is supplied to a region of the image carrier where the electrostatic charge image is formed. When the developer contains a carrier, the carrier returns to the developing device while being held by the developing member.

For example, the electrostatic charge image on the image carrier is developed by the flat toner supplied from the developing member, and a toner image corresponding to the electrostatic charge image is formed on the image carrier.

[Flat Toner]

Hereinafter, the flat toner will be described.

The flat toner contains a flat pigment.

Specifically, the flat toner includes flat toner particles containing a flat pigment. The flat toner may contain an external additive.

(Flat Toner Particles)

The flat toner particles contain, for example, a binder resin and a flat pigment. The flat toner particles may contain a colorant other than the flat pigment, a releasing agent, and other components.

—Binder Resin—

Examples of the binder resin include vinyl resins composed of homopolymers of monomers such as styrenes (such as styrene, parachlorostyrene, and a-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene), or copolymers obtained by combining two or more of these monomers.

Examples of the binder resin include a non-vinyl resin such as an epoxy resin, a polyester resin, a polyurethane resin, a polyamide resin, a cellulose resin, a polyether resin, and a modified resin, a mixture of the non-vinyl resin and the vinyl resin, and a graft polymer obtained by polymerizing a vinyl monomer in the presence of the non-vinyl resin.

These binder resins may be used alone or in combination of two or more thereof.

In particular, it is preferable to use an amorphous resin and a crystalline resin as the binder resin.

In this case, the mass ratio (crystalline resin/amorphous resin) of the crystalline resin to the amorphous resin is preferably 3/97 or more and 50/50 or less, and more preferably 7/93 or more and 30/70 or less.

Here, the amorphous resin refers to a resin that is solid at normal temperature and is thermoplasticized at a temperature equal to or higher than the glass transition temperature and has only a stepwise endothermic change instead of a clear endothermic peak in thermal analysis measurement using differential scanning calorimetry (DSC).

On the other hand, the crystalline resin refers to a resin that has a clear endothermic peak instead of a stepwise endothermic change in differential scanning calorimetry (DSC).

Specifically, for example, the crystalline resin means that the half-value width of the endothermic peak measured at a temperature rising rate of 10° C./min is within 10° C., and the amorphous resin means a resin having a half-value width exceeding 10° C. or a resin for which a clear endothermic peak is not recognized.

The amorphous resin will be described.

Examples of the amorphous resin include known amorphous resins such as an amorphous polyester resin, an amorphous vinyl resin (such as a styrene acrylic resin), an epoxy resin, a polycarbonate resin, and a polyurethane resin. Among these, the amorphous polyester resin and the amorphous vinyl resin (particularly, a styrene acrylic resin) are preferred, and the amorphous polyester resin is more preferred.

It is also preferable to use an amorphous polyester resin and a styrene acrylic resin in combination as the amorphous resin. It is also preferable to use an amorphous resin having an amorphous polyester resin segment and a styrene acrylic resin segment as the amorphous resin.

Examples of the crystalline resin include known crystalline resins such as crystalline polyester resins and crystalline vinyl resins (such as polyalkylene resins and long-chain alkyl (meth)acrylate resins). Among these, the crystalline polyester resin is preferred from the viewpoint of mechanical strength and low-temperature fixability of the flat toner.

The content of the binder resin is preferably 40 mass % or more and 95 mass % or less, more preferably 50 mass % or more and 90 mass % or less, and still more preferably 60 mass % or more and 85 mass % or less, based on the total flat toner particles.

—Flat Pigment—

The flat pigment is preferably a brilliant pigment.

Examples of the brilliant pigment include a pigment (brilliant pigment) capable of providing brilliance such as metallic luster. Specific examples of the brilliant pigment include metal powders such as aluminum (metal of Al alone), brass, bronze, nickel, stainless steel, and zinc; mica coated with titanium oxide, yellow iron oxide, or the like; coated flaky inorganic crystal substrates such as barium sulfate, layered silicate, and layered aluminum silicate; single crystal plate-shaped titanium oxide; basic carbonate; bismuth oxychloride; natural guanine; flaky glass powder; and metal-deposited flaky glass powder, and the brilliant pigment is not particularly limited as long as it has brilliance.

Among these, as the brilliant pigment, metal powder is preferred particularly from the viewpoint of specular reflection intensity, and among these, aluminum is most preferred.

The average length in the long axis direction of the flat pigment is preferably 1 μm or more and 30 μm or less, more preferably 3 μm or more and 20 μm or less, and still more preferably 5 μm or more and 15 μm or less.

When the average length in the thickness direction of the flat pigment is set as 1, the ratio (aspect ratio) of the average length in the long axis direction to the average length in the thickness direction is preferably 5 or more and 200 or less, more preferably 10 or more and 100 or less, and still more preferably 30 or more and 70 or less.

The respective average length and the aspect ratio of the flat pigment are measured by the following method. Using a scanning electron microscope (S-4800, manufactured by Hitachi High-Tech Corporation), a photograph of the flat pigment is taken at a measurable magnification (300 to 100,000 times), the length in the long axis direction and the length in the thickness direction of each particle are measured in a state where the obtained image of the flat pigment is converted into a two-dimensional image, and the average length in the long axis direction of the flat pigment and the aspect ratio of the flat pigment are calculated.

Here, the length in the long axis direction of the flat pigment refers to the longest portion when the flat pigment is observed in the thickness direction of the flat pigment. The length in the thickness direction of the flat pigment refers to the longest portion when the flat pigment is observed from a direction orthogonal to the thickness direction of the flat pigment.

The volume average particle diameter of the flat pigment is preferably 1.0 μm or more and 20.0 μm or less, and more preferably 2.0 μm or more and 15.0 μm or less.

The volume average particle diameter of the flat pigment is measured as follows.

A cumulative distribution is drawn from a small particle diameter side with respect to the divided particle size range (so-called channel) based on the volume-based particle diameter distribution measured by a measuring instrument such as Multisizer II (manufactured by Beckman Coulter, Inc.), and the particle diameter corresponding to the cumulative percentage of 50% is defined as the volume average particle diameter.

As a method of measuring the volume average particle diameter of the flat pigment in the flat toner particles after the production, a solvent capable of dissolving only the resin without dissolving the flat pigment and the flat toner are mixed and stirred, and after the resin is sufficiently dissolved in the solvent, the flat pigment is subjected to solid-liquid separation, and the volume average particle diameter is measured by the same particle size distribution measuring device as described above.

The content of the flat pigment with respect to the total mass of the flat toner particles is preferably 1 mass % or more and 70 mass % or less, more preferably 5 mass % or more and 50 mass % or less, and still more preferably 5 mass % or more and 40 mass % or less.

Colorant Other than Flat Pigment

Examples of the colorant other than the flat pigment include pigments such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant other than the flat pigment may be used alone or in combination of two or more kinds thereof.

As the colorant other than the flat pigment, a colorant surface-treated as necessary may be used, or the colorant may be used in combination with a dispersant. Plural kinds of colorants may be used in combination.

The content of the colorant other than the flat pigment is adjusted according to the color tone of the flat toner.

—Releasing Agent—

Examples of the releasing agent include: hydrocarbon wax; natural wax such as carnauba wax, rice wax, and candelilla wax; synthetic wax or mineral or petroleum such as montan wax; and ester wax such as fatty acid ester and montanic acid ester. The releasing agent is not limited thereto.

The melting temperature of the releasing agent is preferably 50° C. or higher and 110° C. or lower, and more preferably 60° C. or higher and 100° C. or lower.

The melting temperature of the releasing agent is determined based on "melting peak temperature" described in the method of determining the melting temperature in JIS K7121: 1987 "Testing Methods for Transition Temperatures of Plastics" from a DSC curve obtained by differential scanning calorimetry (DSC).

The content of the releasing agent with respect to the entire flat toner particles is preferably 1 mass % or more and 20 mass % or less, and more preferably 5 mass % or more and 15 mass % or less.

—Other Additives—

Examples of the other additives include known additives such as a magnetic body, an electrostatic charge control agent, and an inorganic powder. These additives are contained in the flat toner particles as internal additives.

Properties of Flat Toner Particles

The flat toner particles have a flake shape, and the average circle-equivalent diameter D is larger than the average maximum thickness C.

When the flat toner particles have a flake shape in which the circle-equivalent diameter is larger than the thickness (see FIG. 2), it is considered that the flat toner particles are arranged such that the flat surface sides of the flat toner particles face the surface of the recording medium due to the pressure at the time of fixing in the fixing step of image formation. In FIG. 2, reference numeral 2 denotes a flat toner particle, reference numeral 4 denotes a flat pigment, and reference numeral L denotes a thickness of the flat toner particle.

The ratio C/D of the average maximum thickness C to the average circle-equivalent diameter D is preferably within the range of 0.001 or more and 0.700 or less, more preferably within the range of 0.001 or more and 0.500 or less, still more preferably within the range of 0.100 or more and 0.600 or less, and particularly preferably within the range of 0.300 or more and 0.450 or less.

When the ratio C/D is 0.001 or more, the strength of the toner particles is ensured, breakage due to stress at the time of image formation is prevented, and a decrease in charging due to exposure of the flat pigment and fogging caused as a result are prevented. On the other hand, in a case where the flat pigment is a brilliant pigment, excellent brilliance may be obtained when the ratio C/D is 0.700 or less.

The average maximum thickness C and the average circle-equivalent diameter D described above are measured by the following method.

The flat toner particles are placed on a smooth surface, and are subjected to vibration to be dispersed without unevenness. 1,000 toner particles are enlarged by 1,000 times using a color laser microscope "VK-9700" (manufactured by Keyence Corporation), the maximum thickness C of the toner particles and the circle-equivalent diameter D of the surface seen from above are measured, and the arithmetic mean values of the maximum thickness C and the circle-equivalent diameter D are determined, thereby calculating the average maximum thickness C and the average circle-equivalent diameter D.

In a case where the cross-sections of the flat toner particles in the thickness direction are observed, the proportion (number basis) of the flat pigments in which the angle between the long axis direction of the toner particle in the cross-section and the long axis direction of the flat pigment is within the range of −30° to +300 is preferably 60% or more in all the flat pigments to be observed. Further, the above proportion is more preferably 70% or more and 95% or less, and particularly preferably 80% or more and 90% or less.

In a case where the flat pigment is a brilliant pigment, excellent brilliance is obtained when the above proportion is 60% or more.

Here, a method of observing the cross sections of the flat toner particles will be described.

The toner particles are embedded using a bisphenol A type liquid epoxy resin and a curing agent, and then a sample for cutting is prepared. Next, the sample for cutting is cut at −100° C. using a cutting machine that uses a diamond knife, for example, an Ultramicrotome device (UltracutUCT, manufactured by Leica) to prepare a sample for observation.

The sample for observation is observed with, for example, an ultrahigh resolution field emission scanning electron microscope (S-4800, manufactured by Hitachi High-Tech Corporation) at a magnification at which approximately one to ten flat pigment toner particles can be seen in one field of view.

Specifically, the cross sections of the flat toner particles (more specifically, the cross sections along the thickness direction of the flat toner particles) are observed, and regarding the observed 100 flat toner particles, the number of flat pigments in which the angle between the long axis direction of the cross section of the flat toner particles and the long axis direction of the flat pigment is within the range of −30° to +30° is counted using, for example, image analysis software such as image analysis software (Win ROOF) manufactured by Mitani Corporation, or an output sample of the observed image and a protractor, and the ratio thereof is calculated.

The volume average particle diameter of the flat toner particles is preferably 3 μm or more and 30 μm or less, and more preferably 5 μm or more and 20 μm or less.

Various average particle diameters and various particle size distribution indices of the flat toner particles are measured using a Coulter Multisizer II (manufactured by Beckman Coulter, Inc.) and the electrolytic solution is ISOTON-II (manufactured by Beckman Coulter, Inc.).

In the measurement, 0.5 mg or more and 50 mg or less of a measurement sample is added to 2 ml of a 5% aqueous solution of a surfactant (preferably sodium alkylbenzenesulfonate) as a dispersant. The obtained mixture is added to 100 ml or more and 150 ml or less of the electrolytic solution.

The electrolytic solution in which the sample is suspended is subjected to a dispersion treatment for 1 minute with an ultrasonic disperser, and the Coulter Multisizer II is used to measure the particle size distribution of particles having a particle diameter within the range of 2 μm or more and 60 μm or less using an aperture having an aperture diameter of 100 μm. The number of particles to be sampled is 50,000.

A cumulative distribution is drawn from the small particle diameter side with respect to the divided particle diameter range (so-called channel) based on the measured volume-based particle diameter distribution, and a particle diameter corresponding to the cumulative percentage of 16% is defined as a volume particle diameter D16v, a particle diameter corresponding to the cumulative percentage of 50% is defined as a volume average particle diameter D50v, and a particle diameter corresponding to the cumulative percentage of 84% is defined as a volume particle diameter D84v.

A cumulative distribution is drawn from the small particle diameter side with respect to the divided particle diameter range (so-called channel) based on the measured number-based particle diameter distribution, and a particle diameter corresponding to the cumulative percentage of 16% is defined as a number particle diameter D16p, a particle diameter corresponding to the cumulative percentage of 50% is defined as a number average particle diameter D50p, and a particle diameter corresponding to the cumulative percentage of 84% is defined as a number particle diameter D84p.

Using these, the volume particle size distribution index (GSDv) is calculated as $(D84v/D16v)^{1/2}$, and the number particle size distribution index (GSDp) is calculated as $(D84p/D16p)^{1/2}$ (External Additive)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as the external additive are preferably subjected to a hydrophobic treatment. The hydrophobic treatment is performed, for example, by immersing the inorganic particles in a hydrophobic treatment agent. The hydrophobic treatment agent is not particularly limited, and examples thereof include a silane coupling agent, a silicone oil, a titanate coupling agent, and an aluminum coupling agent. The hydrophobic treatment agent may be used alone or in combination of two or more thereof.

The amount of the hydrophobic treatment agent is generally, for example, 1 part by mass or more and 10 parts by mass or less based on 100 parts by mass of the inorganic particles.

Examples of the external additive also include resin particles (resin particles such as polystyrene, polymethylmethacrylate (PMMA), and melamine resin), and cleaning activators (for example, metal salts of higher fatty acids represented by zinc stearate, and particles of a fluoropolymer).

The amount of the external additive externally added is, for example, preferably 0.01 mass % or more and 5 mass % or less, and more preferably 0.01 mass % or more and 2.0 mass % or less, based on the toner particles.

(Method for Producing Flat Toner)

The flat toner is obtained, for example, by preparing flat toner particles and then externally adding an external additive to the flat toner particles.

The flat toner particles may be produced by either a dry production method (e.g., a kneading pulverization method) or a wet production method (e.g., an aggregation and coalescence method, a suspension polymerization method, and a dissolution suspension method). These production methods are not particularly limited, and known production methods are employed. Among these, the flat toner particles are preferably obtained by the aggregation and coalescence method.

[Developer]

The developer may be a one-component developer containing only the flat toner, or may be a two-component developer obtained by mixing the flat toner with a carrier.

The carrier is not particularly limited, and examples thereof include known carriers. Examples of the carrier include a coated carrier in which a surface of a core made of a magnetic powder is coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores, and the core is coated with a coating resin.

The mixing ratio (mass ratio) of the toner to the carrier in the two-component developer is preferably toner:carrier=1:100 to 30:100, and more preferably 3:100 to 20:100.

[Transfer Device]

A transfer device includes an intermediate transfer belt having an outer circumferential surface onto which a toner image is transferred, a primary transfer device including a primary transfer member that primarily transfers the toner image formed on a surface of an image carrier onto the outer circumferential surface of the intermediate transfer belt, and a secondary transfer device coming into contact with the outer circumferential surface of the intermediate transfer belt and including a secondary transfer member that secondarily transfers the toner image transferred onto the outer circumferential surface of the intermediate transfer belt onto a surface of a recording medium. The details of the intermediate transfer belt will be described later.

In the primary transfer device, the primary transfer member faces the image carrier with the intermediate transfer belt interposed therebetween. In the primary transfer device, the toner image is primarily transferred onto the outer circumferential surface of the intermediate transfer belt by applying a voltage having a polarity opposite to the charging polarity of the toner to the intermediate transfer belt by means of the above primary transfer member.

The secondary transfer member of the secondary transfer device is disposed on the toner image carrying side of the intermediate transfer belt. Then, the secondary transfer device includes, for example, a back surface member disposed on a side opposite to the toner image carrying side of the intermediate transfer belt, together with the secondary transfer member. In the secondary transfer device, the toner image on the intermediate transfer belt is secondarily transferred to the recording medium by sandwiching the intermediate transfer belt and the recording medium between the secondary transfer member and the back surface member to form a transfer electric field.

The second transfer member may be a second transfer roller or a second transfer belt. As the back surface member, for example, a back surface roller is applied.

The transfer device according to the present exemplary embodiment may be a transfer device that transfers a toner image onto a surface of a recording medium via plural intermediate transfer bodies. That is, the transfer device may be, for example, a transfer device that primarily transfers the toner image from the image carrier to the first intermediate transfer belt, secondarily transfers the toner image from the first intermediate transfer belt to the second intermediate transfer body, and then tertiarily transfers the toner image from the second intermediate transfer body to the recording medium.

When the transfer device includes plural intermediate transfer bodies, at least a transfer belt to be described later is applied to an intermediate transfer belt that transfers a toner image to a recording medium.

[Intermediate Transfer Belt]

The intermediate transfer belt has the following adhesive force properties.

(Adhesive Force Properties)

The intermediate transfer belt has a property that, after the flat toner adheres to the outer circumferential surface, when air is blown to the outer circumferential surface from an upper side of the outer circumferential surface while increasing the blowing pressure, all the flat toner adhering to the outer circumferential surface is separated from the outer circumferential surface at a blowing pressure of 25 kPa or less (preferably 20 kPa or less, and more preferably 10 kPa or less from the viewpoint of preventing a transfer failure of a toner image formed of flat toner).

By satisfying the adhesive force properties, the non-electrostatic adhesive force generated between the outer circumferential surface of the intermediate transfer belt and the toner is reduced, the transferability is improved, and the transfer failure is prevented even when the flat toner is used.

In this case, from the viewpoint of preventing a transfer failure of a toner image formed of flat toner, the intermediate transfer belt preferably has a property that, after the flat toner adheres to the outer circumferential surface, when air is blown to the outer circumferential surface from an upper side of the outer circumferential surface while increasing the blowing pressure, all the flat toner adhering to the outer circumferential surface is separated from the outer circumferential surface at a blowing pressure of 2 kPa or more.

When the adhesive force between the intermediate transfer belt and the flat toner reaches a certain degree, the flat toner is fixed onto the outer circumferential surface of the intermediate transfer belt, and transfer failure may be likely to be prevented.

Here, whether the adhesive force properties are satisfied is determined as follows.

First, a sample piece of 3 cm×4 cm square is collected from a target intermediate transfer belt.

Next, under an environment with a temperature of 22° C. and a humidity of 15%, a voltage of 10 kV is applied to a surface of the sample piece corresponding to the outer circumferential surface of the intermediate transfer belt from above at a height of 15 cm in a direction parallel to the surface corresponding to the outer circumferential surface of the intermediate transfer belt, and in this state, the target flat toner is sprayed and adheres to the surface of the sample piece in a loading amount of 3 g/cm$^2$.

Next, at the central portion of a flat toner adhesion surface of the sample piece, blowing of air is started at a blowing pressure of 0.1 kPa from an air blowing port having a diameter of 0.7 mm positioned above 3 cm in height, and the blowing pressure is increased at 0.5 kPa/sec.

Then, when the blowing pressure reaches 25 kPa, it is determined that the adhesive force properties are satisfied when all the flat toner is separated from the sample piece.

In contrast, when the flat toner remains on the sample piece even if the blowing pressure exceeds 25 kPa, it is determined that the adhesive force properties are not satisfied.

(Surface Free Energy)

The surface free energy of the outer circumferential surface of the intermediate transfer belt is preferably 47 mN/m or less, more preferably 40 mN/m or less, and still more preferably 35 mN/m or less, from the viewpoint of preventing a transfer failure of a toner image formed of flat toner. The lower limit of the surface free energy is, for example, 10 mN/m or more from the viewpoint of the cleaning property of the belt.

The surface free energy is measured by using a contact angle meter CAM-200 (manufactured by KSV) and calculating the surface free energy by a built-in program calculation using the Zisman method.

(Water Contact Angle)

The water contact angle of the outer circumferential surface of the intermediate transfer belt is preferably 80° or more, more preferably 850 or more, still more preferably 90° or more, and particularly preferably 950 or more, from the viewpoint of preventing a transfer failure of a toner image formed of flat toner. The lower limit of the water contact angle is, for example, 1100 or less from the viewpoint of cleaning properties of a belt.

The water contact angle is an index indicating water repellency, and is measured as follows.

In an environment with a temperature of 25° C. and a humidity of 50%, 3 μl of pure water is added dropwise onto the surface of an object to be measured using a contact angle meter (manufactured by Kyowa Interface Science Co., Ltd., model number: CA-X-FACE), and images of liquid droplets after three seconds from the dropwise addition are captured by an optical microscope. Then, the water contact angle θ is determined from the obtained captured photograph based on the θ/2 method.

(Layer Configuration)

The intermediate transfer belt contains a resin and conductive carbon particles. The intermediate transfer belt preferably further contains a surfactant from the viewpoint of satisfying the above adhesive force properties, the above surface free energy, and the water contact angle.

Specifically, the intermediate transfer belt may be a single-layer body of a layer containing a resin, conductive carbon particles, and a surfactant, or a laminate including a layer containing a resin, conductive carbon particles, and a surfactant as an outermost surface layer.

Examples of the laminate include a laminate having two or more layers, which includes a base layer containing a resin and conductive carbon particles, and an outermost surface layer containing a resin, conductive carbon particles, and a surfactant which is provided the outer circumferential surface side of the base layer.

Each layer may contain other components.

—Resin—

Examples of the resin include a polyimide resin (PI resin), a polyamide-imide resin (PAI resin), an aromatic polyether ketone resin (for example, an aromatic polyether ether ketone resin), a polyphenylene sulfide resin (PPS resin), a polyetherimide resin (PEI resin), a polyester resin, a polyamide resin, and a polycarbonate resin. From the viewpoint of mechanical strength and dispersibility of the conductive carbon particles, the resin preferably contains at least one selected from the group consisting of a polyimide resin, a polyamide-imide resin, an aromatic polyether ether ketone resin, a polyetherimide resin, and a polyphenylene sulfide resin, and more preferably contains at least one selected from the group consisting of a polyimide resin and a polyamide-imide resin. Among these, a polyimide resin is more preferred from the viewpoint of mechanical strength. The resin may be one kind of resin, or may be a mixture of two or more kinds of resins.

Examples of the polyimide resin include an imidized product of a polyamic acid (that is, a precursor of a polyimide resin) which is a polymer of a tetracarboxylic dianhydride and a diamine compound.

Examples of the polyimide resin include a resin having a structural unit represented by the following general formula (I).

General Formula (I)

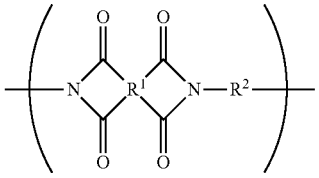

In Formula (I), $R^1$ represents a tetravalent organic group, and $R^2$ represents a divalent organic group.

Examples of the tetravalent organic group represented by $R^1$ include an aromatic group, an aliphatic group, a cyclic aliphatic group, a group obtained by combining an aromatic group and an aliphatic group, and a group obtained by substituting these groups. Specific examples of the tetravalent organic group include a residue of tetracarboxylic dianhydride described below.

Examples of the divalent organic group represented by $R^2$ include an aromatic group, an aliphatic group, a cyclic aliphatic group, a group obtained by combining an aromatic group and an aliphatic group, and a group obtained by substituting these groups. Specific examples of the divalent organic group include a residue of a diamine compound described below.

Specific examples of the tetracarboxylic dianhydride used as a raw material of the polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl) ether dianhydride, and ethylenetetracarboxylic dianhydride.

Specific examples of the diamine compound used as a raw material for the polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenylsulfide, 3,3'-diaminodiphenylsulfone, 1,5-diaminonaphthalene, m-phenylenediamine, p-phenylenediamine, 3,3'-dimethyl 4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-aminotertiary butyl) toluene, bis(p-β-amino-third butylphenyl) ether, bis(p-β-methyl-δ-aminophenyl) benzene, bis-p-(1,1-dimethyl-5-aminopentyl) benzene, 1-isopropyl-2,4-m-phenylenediamine, m-xylylenediamine, p-xylylenediamine, di(p-aminocyclohexyl) methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy) phenyl] propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

—Polyamide-Imide Resin—

Examples of the polyamide-imide resin include a resin having an imide bond and an amide bond in a repeating unit.

More specifically, examples of the polyamide-imide resin include a polymer of a trivalent carboxylic acid compound having an acid anhydride group (also referred to as a tricarboxylic acid) and a diisocyanate compound or a diamine compound.

The tricarboxylic acid is preferably trimellitic anhydride or a derivative thereof. In addition to the tricarboxylic acid, a tetracarboxylic dianhydride, an aliphatic dicarboxylic acid, and an aromatic dicarboxylic acid may be used in combination.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds having the same structure as the above isocyanate and having an amino group instead of an isocyanato group.

—Aromatic Polyether Ketone Resin—

Examples of the aromatic polyether ketone resin include a resin in which aromatic rings such as a benzene ring are bonded linearly by an ether bond and a ketone bond.

Examples of the aromatic polyether ketone resin include a polyether ketone (PEK) in which an ether bond and a ketone bond are alternately arranged, a polyether ether ketone (PEEK) in which an ether bond, an ether bond, and a ketone bond are arranged in this order, a polyether ketone ketone (PEKK) in which an ether bond, a ketone bond, and a ketone bond are arranged in this order, a polyether ether ketone ketone (PEEKK) in which an ether bond, an ether bond, a ketone bond, and a ketone bond are arranged in this order, and a polyether ketone ester containing an ester bond.

The content of the resin is preferably 60 mass % or more and 95 mass % or less, more preferably 70 mass % or more and 95 mass % or less, and still more preferably 75 mass % or more and 90 mass % or less, from the viewpoint of mechanical strength, adjusting volume resistivity, and the like.

(Conductive Carbon Particles)

Examples of the conductive carbon particles include carbon black.

Examples of the carbon black include Ketjen black, oil furnace black, channel black, and acetylene black. As the carbon black, carbon black whose surface is treated (hereinafter, also referred to as "surface-treated carbon black") may be used.

The surface-treated carbon black is obtained by imparting, for example, a carboxy group, a quinone group, a lactone group, a hydroxy group, or the like to the surface thereof. Examples of the methods of the surface treatment include an air oxidation method in which carbon black is brought into contact with the air and reacts with the air under a high temperature atmosphere, a method in which carbon black reacts with nitrogen oxide or ozone under a normal temperature (for example, 22° C.), and a method in which carbon black is subjected to air oxidation under a high temperature atmosphere and then oxidized with ozone at a low temperature.

Among these, the carbon black is preferably a channel black, and more preferably a surface-treated channel black.

The pH of the conductive carbon particles is, for example, within the range of 1.0 or more and 5.5 or less, and preferably within the range of 1.0 or more and 3.0 or less.

The number average primary particle diameter of the conductive carbon particles is preferably 40 nm or less, more preferably 20 nm or less, still more preferably 18 nm or less, particularly preferably 15 nm or less, and most preferably 13 nm or less from the viewpoint of dispersibility, mechanical strength, volume resistivity, film formability, and the like.

On the other hand, the number average primary particle diameter of the conductive carbon particles is preferably 2 nm or more, more preferably 5 nm or more, and still more preferably 10 nm or more.

The number average primary particle diameter of the conductive carbon particles is measured by the following method.

First, a measurement sample having a thickness of 100 nm is collected from the obtained belt with a microtome, and the measurement sample is observed with a transmission electron microscope (TEM). Then, a diameter of a circle (that is, a circle-equivalent diameter) equal to a projected area of each of 50 conductive carbon particles is defined as a particle diameter, and an average value thereof is defined as the number average primary particle diameter.

The content of the conductive carbon particles is preferably 10 mass % or more and 50 mass % or less, more preferably 13 mass % or more and 40 mass % or less, and still more preferably 15 mass % or more and 30 mass % or less, with respect to the entire layer, from the viewpoint of ensuring strength.

—Surfactant—

Preferred examples of the surfactant include surfactants having at least one of a perfluoroalkyl structure, an alkylene oxide structure, and a silicone structure.

When a surfactant having such a structure is used, the adhesive force properties, the surface free energy, the water contact angle, and the diiodomethane contact angle are satisfied, and transferability to uneven paper may be easily improved.

Preferred examples of the surfactant having a perfluoroalkyl structure include perfluoroalkyl sulfonic acids (such as perfluorobutane sulfonic acid and perfluorooctane sulfonic acid), perfluoroalkyl carboxylic acids (such as perfluorobutane carboxylic acid and perfluorooctane carboxylic acid), and perfluoroalkyl group-containing phosphate esters. The perfluoroalkyl sulfonic acids and the perfluoroalkylcarboxylic acids may be salts thereof and amide-modified products thereof.

Examples of commercially available products of surfactants having a perfluoroalkyl structure include Megaface series (manufactured by DIC Corporation), F-top series (manufactured by JEMCO Corporation), Ftergent series (manufactured by Neos Corporation), Surflon series (manufactured by AGC Seimi Chemical Co., Ltd.), PF series (manufactured by Kitamura Chemical Co., Ltd.), and FC series (manufactured by 3M Corporation).

Examples of the surfactant having an alkylene oxide structure include polyethylene glycol, a polyether defoaming agent, and a polyether-modified silicone oil.

The polyethylene glycol preferably has a number average molecular weight of 2000 or less, and examples of the polyethylene glycol having a number average molecular weight of 2,000 or less include polyethylene glycol 2000 (having a number average molecular weight of 2,000), polyethylene glycol 600 (having a number average molecular weight of 600), polyethylene glycol 400 (having a number average molecular weight of 400), and polyethylene glycol 200 (having a number average molecular weight of 200).

Examples of the polyether defoaming agent include PE series (manufactured by Wako Pure Chemical Industries, Ltd.) and defoaming agent series (manufactured by Kao Corporation).

Examples of the polyether-modified silicone oil include a silicone oil in which at least one of a side chain and a terminal of a polysiloxane chain is modified with a polyalkylene oxide.

Examples of the surfactant having a silicone structure include general silicone oils such as dimethyl silicone, methylphenyl silicone, diphenyl silicone, and derivatives thereof.

Examples of the surfactant having a silicone structure include KF series 351(A), KF352(A), KF353(A), KF354(A), KF355(A), KF615(A), KF618, KF945(A), KF6004, KP126, and KP109 (all manufactured by Shin-Etsu Chemical Co., Ltd.), TSF series (manufactured by GE Toshiba Silicones Co., Ltd.), BYK series-UV series (manufactured by BYK Japan KK), and Ogrol series (manufactured by Osaka Gas Chemicals Co., Ltd.).

Among these, the surfactant is preferably at least one of an oligomer having a substituent having 6 or less carbon atoms and a fluorine atom and an oligomer having a silicone structure having a methyl group.

When these surfactants are used, adhesive force properties, surface free energy, and a water contact angle may be easily satisfied, and the transfer failure of a toner image formed of flat toner may be easily prevented.

Here, the oligomer having a substituent having 6 or less carbon atoms and a fluorine atom may be an oligomer having a perfluoroalkyl structure having 6 or less carbon atoms (preferably 2 or more and 6 or less carbon atoms). An oligomer having a perfluoroalkyl structure having 6 or less carbon atoms (preferably 2 or more and 6 or less carbon atoms) is preferred from the viewpoint of satisfying adhesive force properties, surface free energy, and a water contact angle and preventing a transfer failure of a toner image formed of flat toner.

The oligomer having a silicone structure having a methyl group is preferably an oligomer having at least one of a "—$SiH(CH_3)$—O—" structure, a "—$Si(CH_3)_2$—O—" structure, and a "—$Si(CH_3)(Ph)$—O—" structure (in the structural formula, Ph represents a phenyl group) as a silicone structure, from the viewpoint of satisfying adhesive force properties, surface free energy, and a water contact angle and preventing a transfer failure of a toner image formed of flat toner.

The surfactant may be an oligomer having a silane structure with a methyl group. Specifically, the oligomer having a silane structure with a methyl group is preferably an oligomer having at least one of a —$[SiH(CH_3)]_n$— structure, a —$[Si(CH_3)_2]_n$— structure, and a —$[Si(CH_3)(Ph)]_n$— structure (in the structural formula, Ph represents a phenyl group and n represents an integer of 2 or more).

From the viewpoint of satisfying adhesive force properties, surface free energy, and a water contact angle and preventing a transfer failure of a toner image formed of flat toner, these oligomers are preferably a polymer obtained by bonding four or more monomers. That is, the number of repeating units of the monomer in the oligomer is preferably 4 or more.

The oligomer is preferably a polymer obtained by bonding 4 or more and 1000 or less (more preferably 4 or more and 300 or less) monomers. That is, the number of repeating units of the monomer in the oligomer is preferably 4 or more and 1000 or less (more preferably 4 or more and 300 or less).

The monomer in the oligomer is a monomer having a perfluoroalkyl structure (e.g., (meth)acrylate) in the case of the oligomer having a perfluoroalkyl structure having 6 or less carbon atoms, and is a siloxane having a methyl group in the case of the oligomer having a silicone structure having a methyl group.

The content of the surfactant is adjusted to a range satisfying adhesive force properties, surface free energy, and the water contact angle.

The content of the surfactant is preferably 0.5 mass % or more and 10 mass % or less, more preferably 0.7 mass % or more and 7 mass % or less, and still more preferably 1.0 mass % or more and 5 mass % or less with respect to the layer containing the surfactant.

—Other Components—

Examples of the other components include a conductive agent other than the conductive carbon particles, a filler for improving the strength of a belt, an antioxidant for preventing thermal deterioration of the belt, a surfactant for improving fluidity, and a thermal anti-aging agent.

(Volume Resistivity of Intermediate Transfer Belt)

The common logarithmic value of the volume resistivity at the time of applying a voltage of 500V to the intermediate transfer belt for 10 seconds is preferably 9.0 (log Ω·cm) or more and 13.5 (log Ω·cm) or less, more preferably 9.5 (log Ω·) or more and 13.2 (log Ω·cm) or less, and particularly preferably 10.0 (log 0.0 cm) or more and 12.5 (log Ω·cm) or less, from the viewpoint of preventing a transfer failure of a toner image formed of flat toner.

The volume resistivity at the time of applying a voltage of 500V to the intermediate transfer belt for 10 seconds is measured by the following method.

Using a micro ammeter (R8430A manufactured by Advantest Corporation) as a resistance measuring instrument and using a UR probe (manufactured by Mitsubishi Chemical Analytech Co., Ltd.) as a probe, the volume resistivity (log Ω·cm) of the intermediate transfer belt is measured at a total of 18 points, which are arranged such that 6 points are located in the circumferential direction at equal intervals and 3 points are located in the central portion and both end portions in the width direction, a voltage of 500V, an application time of 10 seconds, and a pressure of 1 kgf, and the average value is calculated. In addition, the measurement is performed in an environment of a temperature of 22° C. and a humidity of 55% RH.

(Surface Resistivity of Intermediate Transfer Belt)

The common logarithmic value of the surface resistivity at the time of applying a voltage of 500V to the intermediate transfer belt for 10 seconds is preferably 10.0 (log Ω/suq.) or more and 15.0 (log Ω/suq.) or less, more preferably 10.5 (log Ω/suq.) or more and 14.0 (log Ω/suq.) or less, and particularly preferably 11.0 (log Ω/suq.) or more and 13.5 (log Ω/suq.) or less, from the viewpoint of preventing a transfer failure of a toner image formed of flat toner.

The unit of the surface resistivity log Ω/suq. represents the surface resistivity with a logarithmic value of the resistance value per unit area, and is also expressed as log (Ω/suq.), log Ω/square, log Ω/□, or the like.

The surface resistivity at the time of applying a voltage of 500V to the outer circumferential surface of the intermediate transfer belt for 10 seconds is measured by the following method.

Using a micro ammeter (R8430A manufactured by Advantest Corporation) as a resistance measuring instrument and using a UR probe (manufactured by Mitsubishi Chemical Analytech Co., Ltd.) as a probe, the surface resistivity (log Ω/suq.) of the outer circumferential surface of the intermediate transfer belt is measured at a total of 18 points of the outer circumferential surface of the intermediate transfer belt, which are arranged such that 6 points are located in the circumferential direction at equal intervals and 3 points are located in the central portion and both end portions in the width direction, a voltage of 500V, an application time of 10 seconds, and a pressure of 1 kgf, and the average value is calculated. In addition, the measurement is performed in an environment of a temperature of 22° C. and a humidity of 55% RH.

(Method of Manufacturing Intermediate Transfer Belt)

The method of manufacturing the intermediate transfer belt is not particularly limited.

An example of the method of manufacturing the intermediate transfer belt include a method including a step in which a coating liquid containing a resin or a precursor thereof, conductive carbon particles, and a solvent is applied onto the outer periphery of a material to be coated to form a coating film, and the coating film is dried.

In the method of manufacturing the intermediate transfer belt, the coating film dried by the drying may be fired when the precursor of the resin is used.

As another example of the method of manufacturing the intermediate transfer belt, a method of forming a belt by preparing pellets containing a resin and conductive carbon particles and melt-extruding the pellets may be used.

Although the present exemplary embodiment has been described above, the present disclosure is not limited to the above exemplary embodiment, and various modifications, changes, and improvements can be made.

EXAMPLES

Hereinafter, examples of the present disclosure will be described, but the present disclosure is not limited to the following examples. In the following description, all "parts" and "%" are based on mass unless otherwise specified.

<Developer>

[Developer (1)]

(Synthesis of Binder Resin)

Dimethyl adipate: 74 parts

Dimethyl terephthalate: 192 parts

Adduct of bisphenol A and ethylene oxide: 216 parts

Ethylene glycol: 38 parts

Tetrabutoxytitanate (catalyst): 0.037 parts

The above components are put into a heated and dried two-neck flask, and a nitrogen gas is introduced into the container to maintain an inert atmosphere. The temperature is increased while performing stirring, and then, a co-condensation polymerization reaction is performed at 160° C. for 7 hours. Thereafter, the temperature is increased to 220° C. while gradually reducing the pressure to 10 Torr, and the mixture is maintained for 4 hours. Once the pressure returns to the normal pressure, 9 parts of trimellitic anhydride is added, the pressure is gradually reduced again to 10 Torr, and the thus-obtained product is maintained at 220° C. for 1 hour to synthesize a binder resin.

The glass transition temperature (Tg) of the binder resin is determined by performing measurement under a condition of raising the temperature from the room temperature (25° C.) to 150° C. at a heating rate of 10° C./min using a differential scanning calorimeter (DSC-50, manufactured by Shimadzu Corporation) in accordance with ASTMD3418-8. The glass transition temperature is defined as the temperature at an intersection of extended lines of a base line and a rising line in a heat absorbing section. The glass transition temperature of the binder resin is 63.5° C.

(Preparation of Resin Particle Dispersion Liquid)

Binder resin: 160 parts

Ethyl acetate: 233 parts

Sodium hydroxide aqueous solution (0.3N): 0.1 parts

The above components are put into a 1000 ml separable flask, heated at 70° C., and stirred by a three-one motor (manufactured by Shinto Scientific Co., Ltd.) to prepare a resin mixed liquid. While the resin mixed liquid is further stirred at 90 rpm, 373 parts of ion-exchange water is gradually added to the resin mixed liquid. The resin mixed liquid is subjected to phase inversion emulsification, and the solvent thereof is removed, thereby obtaining a resin particle dispersion liquid (solid content concentration: 30%). The volume average particle diameter of the resin particle dispersion liquid is 162 nm.

(Preparation of Releasing Agent Dispersion Liquid)

Carnauba wax (RC-160, manufactured by Toa Kasei Co., Ltd.): 50 parts

Anionic surfactant (Neogen RK, manufactured by DKS Co. Ltd.): 1.0 part

Ion-exchange water: 200 parts

The above components are mixed and heated to 95° C., and the mixture is dispersed using a homogenizer (ULTRA-TURRAX T50, manufactured by IKA Corporation) and then subjected to a dispersion treatment for 360 minutes using a Manton-Gaulin high-pressure homogenizer (manufactured by Gaulin Corporation) to prepare a releasing agent dispersion liquid (solid content concentration: 20%) in which releasing agent particles having a volume average particle diameter of 0.23 μm are dispersed.

(Preparation of Metal Pigment Particle Dispersion Liquid)

Aluminum pigment (manufactured by Showa Denko K.K., 2173EA): 100 parts

Anionic surfactant (NEOGEN R, manufactured by DKS Co., Ltd.): 1.5 parts

Ion-exchange water: 900 parts

After the solvent is removed from the paste of the aluminum pigment, the above components are mixed, dissolved, and dispersed for about 1 hour by using an emulsification disperser Cavitron (CR1010, manufactured by Pacific Machinery & Engineering Co., Ltd) to prepare a metal pigment particle dispersion liquid (solid content concentration: 10%) in which metal pigment particles (aluminum pigment) are dispersed. The average length of the aluminum pigment (flat pigment) in the long axis direction is 8 μm, and the average length in the thickness direction is 0.1 sm.

(Preparation of External Additive (1))

An external additive (1), which has a surface treatment amount with dimethyl silicone oil of 5 mass % and an average primary particle diameter of 100 nm, is prepared by a sol-gel method.

(Preparation of Flat Toner (1))

Resin particle dispersion liquid: 380 parts

Releasing agent dispersion liquid: 72 parts

Metal pigment particle dispersion liquid: 140 parts

The above metal pigment particle dispersion liquid, the resin particle dispersion liquid, and the releasing agent dispersion liquid are put into a 2 L cylindrical stainless steel container, and are dispersed and mixed for 10 minutes while applying a shearing force at 4000 rpm by a homogenizer (ULTRA-TURRAX T50 manufactured by IKA). Next, 1.75 parts of a 10% nitric acid aqueous solution of polyaluminum chloride as an aggregating agent is gradually added dropwise, and the mixture is dispersed and mixed for 15 minutes at a rotation speed of the homogenizer of 5000 rpm to obtain a raw material dispersion liquid.

Thereafter, the raw material dispersion liquid is transferred to a polymerization vessel equipped with a thermometer and a stirrer using two paddles of stirring blades, and a stirring rotation speed is set to be 810 rpm. The raw material dispersion liquid is heated by a mantle heater to allow aggregated particles to grow at 54° C. At this time, the pH of the raw material dispersion liquid is controlled to be within the range of 2.2 to 3.5 with a 0.3N nitric acid aqueous solution or a 1N sodium hydroxide aqueous solution. The raw material dispersion liquid is maintained within the above pH range for about 2 hours to form aggregated particles.

Next, the resin particle dispersion liquid is further added, and the resin particles of the binder resin adhere to the surfaces of the aggregated particles. The temperature is further raised to 56° C., and the aggregated particles are arranged while confirming the size and form of the particles with an optical microscope and Multisizer II. Thereafter, in order to fuse the aggregated particles, the pH is increased to 8.0, and then the temperature is increased to 67.5° C. After the fusion of the aggregated particles is confirmed by an optical microscope, the pH is lowered to 6.0 while maintaining the temperature at 67.5° C., heating is stopped after 1 hour, and cooling and flattening are performed at a temperature decrease rate of 0.1° C./min. Thereafter, the resultant is sieved with a 20 μm mesh, repeatedly washed with water, and then dried with a vacuum dryer to obtain flat toner particles.

Further, the flat toner particles are subjected to a heat treatment at 45° C. for 1 hour in a hot air dryer.

With respect to 100 parts of the flat toner particles after the heat treatment, 1.2 parts of the external additive (1), 1.5 parts of hydrophobic silica (RY50 manufactured by Nippon Aerosil Co., Ltd.), and 1.0 part of hydrophobic titanium oxide (T805 manufactured by Nippon Aerosil Co., Ltd.) are mixed using a sample mill at 10,000 rpm for 30 seconds. Thereafter, the mixture is sieved with a vibrating sieve having an opening of 45 μm to prepare the flat toner (1).

The volume average particle diameter of the flat toner particles is 12.2 μm, and a ratio C/D of the average maximum thickness C of the flat toner particles to the average circle-equivalent diameter D of the flat toner particles is 0.31.

(Preparation of Carrier)

Ferrite particles (volume average particle diameter: 35 μm): 100 parts

Toluene: 14 parts

Perfluorooctyl ethyl acrylate/methyl methacrylate copolymer: 1.6 parts

Carbon black (trade name: VXC-72, manufactured by Cabot Corporation): 0.12 parts Crosslinked melamine resin particles (average particle diameter: 0.3 μm, insoluble in toluene): 0.3 parts First, carbon black is diluted with toluene and added to a perfluorooctylethyl acrylate/methyl methacrylate copolymer, followed by dispersion with a sand mill. Subsequently, the above component other than the ferrite particles is dispersed in the above mixture with a stirrer for 10 minutes to prepare a coating layer forming solution. Next, the coating layer forming solution and the ferrite particles are put into a vacuum degassing kneader, stirred at a temperature of 60° C. for 30 minutes, and then the pressure is reduced to distill off the toluene, thereby forming a resin coating layer to obtain a carrier.

(Preparation of Developer)

36 parts of the flat toner and 414 parts of the carrier are put into a 2 liter V-blender, stirred for 20 minutes, and then sieved with a sieve having a diameter of 212 μm to prepare the developer (1).

[Developer (2)]

Flat toner (2) is obtained in the same manner as in the preparation of the flat toner (1) except that the amount of the external additive (1) in the preparation of the flat toner (1) is changed to 1.7 parts.

A developer (2) is obtained in the same manner as in the preparation of the developer (1) except that the obtained flat toner (2) is used.

[Developer (3)]

Flat toner (3) is obtained in the same manner as in the preparation of the flat toner (1) except that the external additive (1) in the preparation of the flat toner (1) is not added.

A developer (3) is obtained in the same manner as in the preparation of the developer (1) except that the obtained flat toner (3) is used.

<Intermediate Transfer Belt>

[Intermediate Transfer Belt (1)]

Polyamic acid solution DA-A1 (solid content concentration: 45 mass %): 70 parts by mass Polyamic acid solution DC-A1 (solid content concentration: 15 mass %): 30 parts by mass Acidic carbon black (dry state; conductive carbon particles) [Color Black FW200, manufactured by Orion Engineered Carbons Co., Ltd., gas black (that is, channel black), number average primary particle diameter: 13 nm, pH: 3.0 (hereinafter abbreviated as "FW200")]: 18 parts by mass Surfactant (Surflon S-651): the amount used as the content shown in Table 1 (content with respect to the layer containing a surfactant (the same applies hereinafter))

The polyamic acid solution DA-A1 and the polyamic acid solution DC-A1 having the above composition are mixed, the surfactant is added together with FW200, and the mixture is dispersed in a mixed solution of the polyamic acid solution by being subjected to a dispersion treatment at 30° C. by a ball mill for 12 hours. Thereafter, the mixed solution in which FW200 is dispersed is filtered through a #800 stainless steel mesh to obtain a coating liquid.

A cylindrical mold made of an SUS material, which has an outer diameter of 366 mm and a length of 400 mm, is prepared as a material to be coated. An outer circumferential surface of the mold is coated with a silicone-based releasing agent (product name: SEPA-COAT SP, manufactured by Shin-Etsu Chemical Co., Ltd.), and a drying treatment (releasing agent treatment) is performed.

The above coating liquid is ejected from a dispenser having a diameter of 1.0 mm and is pressed by a metal blade installed on the mold at a uniform pressure to perform the coating from an end portion of the cylindrical mold while rotating the cylindrical mold subjected to the releasing agent treatment at a speed of 10 rpm in the circumferential direction. The dispenser unit is moved in the axial direction of the cylindrical mold at a speed of 100 mm/min to spirally apply the coating liquid Al on the cylindrical mold, thereby forming a coating film.

Next, the coating film is dried in a drying furnace at 140° C. in an air atmosphere for 15 minutes while being rotated at 10 rpm. The integrated average temperature rising rate A/B in the step of drying the coating film is 6.00° C./min.

Next, the resultant is placed in an oven at an ultimate temperature of 320° C. for 4 hours to obtain an endless belt. The overall film thickness of the endless belt (that is, the film thickness of a single layer) is 80 μm.

The endless belt is removed from the mold, and the removed endless belt is stretched around a holding jig and is cut by a cutter with an adjusted insertion angle to obtain an intermediate transfer belt (1) having a diameter (φ) of 366 mm and a width of 369 mm.

When the surface resistivity of the outer circumferential surface and the volume resistivity of the intermediate transfer belt (1) are measured by the above-described methods, the common logarithmic value of the volume resistivity is 11.4 (log Ω·cm), and the common logarithmic value of the surface resistivity is 11.2 (log C/suq.).

[Intermediate Transfer Belt (2) to (14)]

Intermediate transfer belts (2) to (14) are obtained in the same manner as the intermediate transfer belt (1) except that the kind and the content of the surfactant are changed according to Table 1.

The kinds of the surfactants used in the intermediate transfer belts (1) to (14) are as follows.

Surflon S-431: oligomer having a perfluoroalkyl structure having 5 carbon atoms (an oligomer, which has 30 repeating units, of a monomer having a perfluoroalkyl structure having 5 carbon atoms) manufactured by AGC Seimi Chemical Co., Ltd.

Ftergent 601ADH: oligomer having a perfluoroalkyl structure having 5 carbon atoms (an oligomer, which has 200 repeating units, of a monomer having a perfluoroalkyl structure having 5 carbon atoms) manufactured by NEOS Corporation KP109: oligomer having a silicone structure having a methyl group (repeating number of siloxane: 500) manufactured by Shin-Etsu Chemical Co., Ltd.

KP126: oligomer having a silicone structure having a methyl group (repeating number of siloxane: 500) manufactured by Shin-Etsu Chemical Co., Ltd.

OGSOL SI 10-10: oligomer having a silane structure having a methyl group and a phenyl group (repeating number of silane: 10) manufactured by Osaka Gas Chemicals Co., Ltd.

FC4430: oligomer having a perfluoroalkyl structure having 4 carbon atoms (an oligomer, which has 10 repeating units, of a monomer having a perfluoroalkyl structure having 4 carbon atoms) manufactured by 3M Corporation FC4432: oligomer having a perfluoroalkyl structure having 4 carbon atoms (an oligomer, which has 10 repeating units, of a monomer having a perfluoroalkyl structure having 4 carbon atoms) manufactured by 3M Corporation Here, in Table 1, the column of the number of carbon atoms of the surfactant indicates the number of carbon atoms of the "perfluoroalkyl structure" of the surfactant, the substituent (methyl group) of the siloxane, and the substituent (phenyl group) of the silane.

circumferential surface are separated from the outer circumferential surface at a blowing pressure of 25 kPa or less). The numerical values in the column of the adhesion amount properties in Table 1 indicate the blowing pressure of air when all the flat toner adhering to the outer circumferential surface of the intermediate transfer belt is separated from the outer circumferential surface.

Surface free energy (mN/m) of outer circumferential surface of endless belt

Water contact angle (°) of outer circumferential surface of endless belt

Examples 1 to 13 and Comparative Example 1

In the combination shown in Table 1, a developing device for forming a brilliant image of an image forming apparatus "DocuColor-7171P" (manufactured by Fuji Xerox Co., Ltd.) is filled with a developer, and an intermediate transfer belt is incorporated in a transfer device.

Then, the following evaluation is performed using the image forming apparatus.

(Evaluation of Transfer Failure)

Under an environment of a temperature of 22° C. and a humidity of 55% RH and under a condition that a transport speed of a recording medium in a secondary transfer region is 366 mm/s, a blue solid image is formed on the OS-coated paper, and the density unevenness of the image is visually evaluated. The evaluation criteria are as follows, and the results are shown in Table 1.

—Evaluation Criteria—

A: No density unevenness occurred

B: Slight density unevenness occurred

C: Clear density unevenness occurred

TABLE 1

| | | Intermediate transfer belt | | | | | | | |
|---|---|---|---|---|---|---|---|---|---|
| | | | Adhesive force | Surface free | Water contact | Surfactant | | | Evaluation |
| | Developer Kind | Kind | properties (kPa) | energy (mN/m) | angle (°) | Kind | Mass % | Carbon atom number | of transfer failure |
| Example 1 | 1 | 1 | 10.2 | 26.7 | 102 | Surflon S-431 | 5 | 5 | B |
| Example 2 | 2 | 2 | 7.9 | 25 | 103 | Surflon S-431 | 6.5 | 5 | A |
| Example 3 | 2 | 3 | 5.2 | 23 | 101 | Surflon S-431 | 8 | 5 | A |
| Example 4 | 2 | 4 | 22 | 47 | 90 | Surflon S-431 | 2.5 | 5 | B |
| Example 5 | 1 | 5 | 2.5 | 21 | 104 | Surflon S-431 | 10 | 5 | A |
| Example 6 | 2 | 6 | 1.8 | 19 | 105 | Surflon S-431 | 12 | 5 | B |
| Example 7 | 1 | 7 | 14 | 39 | 95 | KP109 | 5 | 1 | B |
| Example 8 | 2 | 8 | 5.8 | 47 | 97 | Ftergent 601ADH | 6 | 5 | A |
| Example 9 | 2 | 9 | 7.1 | 49 | 95 | Ftergent 601ADH | 5 | 5 | A |
| Example 10 | 2 | 10 | 12 | 44 | 84 | KP126 | 5 | 1 | A |
| Example 11 | 1 | 11 | 20.4 | 42 | 90 | OGSOL SI 10-10 | 5 | 6 | B |
| Example 12 | 1 | 12 | 14.3 | 39 | 96 | FC4430 | 5 | 4 | B |
| Example 13 | 2 | 13 | 7.1 | 35 | 105 | FC4432 | 5 | 4 | A |
| Comparative Example 1 | 3 | 14 | 26 | 55 | 78 | Surflon S-431 | 1.3 | 5 | C |

[Evaluation of Properties of Intermediate Transfer Belt]

The following properties of the intermediate transfer belt are determined according to the method described above. The results are shown in Table 1.

Adhesion amount properties (properties in which after the flat toner adheres to the outer circumferential surface of the intermediate transfer belt when air is blown to the outer circumferential surface from an upper side of the outer circumferential surface while increasing the blowing pressure, all the polyester resin particles adhering to the outer From the above results, it can be seen that the transfer failure of the toner image formed of the flat toner is prevented in the present examples as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A unit comprising:

a developing device configured to develop an electrostatic charge image that is formed on a surface of an image carrier, as a toner image with a developer including a flat toner containing a flat pigment, the developer being accommodated in the developing device; and a transfer device that comprises an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium, wherein the intermediate transfer belt contains a resin, conductive carbon particles, and a surfactant, and the intermediate transfer belt is configured to have an adhesive force property determined as follows: after the flat toner adheres to an outer circumferential surface of the intermediate transfer belt in a loading amount of 3 g/cm$^2$, under an environment with a temperature of 22° C. and a humidity of 15% when a voltage of 10 kV is applied to the outer circumferential surface, in a case where air is blown from an air blowing port having a diameter of 0.7 mm to the outer circumferential surface from a position 3 cm above an upper side of the outer circumferential surface while increasing a blowing pressure at 0.5 kPa/s, all the flat toner adhering to the outer circumferential surface is separated from the outer circumferential surface at a blowing pressure of 25 kPa or less, wherein the flat toner has an average circle-equivalent diameter D that is larger than an average maximum thickness C, wherein the flat pigment has an aspect ratio of an average length in a long axis direction to an average length in a thickness direction of 5 or more and 200 or less, and wherein the surfactant includes an oligomer having a silicone structure having a methyl group.

2. The unit according to claim 1, wherein the unit is configured such that, after the flat toner adheres to the outer circumferential surface of the intermediate transfer belt in a loading amount of 3 g/cm$^2$, in a case where air is blown to the outer circumferential surface from the upper side of the outer circumferential surface while increasing the blowing pressure, all the flat toner adhering to the outer circumferential surface is separated from the outer circumferential surface at a blowing pressure of 2 kPa or more.

3. The unit according to claim 2, wherein the surfactant contains an oligomer having a substituent having 6 or less carbon atoms and a fluorine atom.

4. The unit according to claim 3, wherein the oligomer having a substituent having 6 or less carbon atoms and a fluorine atom is an oligomer having a perfluoroalkyl structure having 6 or less carbon atoms.

5. The unit according to claim 3, wherein the number of repeating units of a monomer in the oligomer having the substituent having 6 or less carbon atoms and the fluorine atom is 4 or more.

6. The unit according to claim 1, wherein the surfactant contains an oligomer having a substituent having 6 or less carbon atoms and a fluorine atom.

7. The unit according to claim 6, wherein the oligomer having a substituent having 6 or less carbon atoms and a fluorine atom is an oligomer having a perfluoroalkyl structure having 6 or less carbon atoms.

8. The unit according to claim 6, wherein the number of repeating units of a monomer in the oligomer having the substituent having 6 or less carbon atoms and the fluorine atom is 4 or more.

9. The unit according to claim 1, wherein the number of repeating units of a monomer in the oligomer is 4 or more.

10. The unit according to claim 1, wherein a surface free energy of the outer circumferential surface of the intermediate transfer belt is 47 mN/m or less.

11. The unit according to claim 10, wherein a water contact angle of the outer circumferential surface of the intermediate transfer belt is 85° or more.

12. The unit according to claim 1, wherein a content of the surfactant is 2.5 mass % or more and 12 mass % or less based on a mass of a layer of the intermediate transfer belt containing the surfactant.

13. An image forming apparatus comprising:

a toner image forming device that comprises an image carrier, and a developing device configured to develop an electrostatic charge image that is formed on a surface of the image carrier, as a toner image with a developer including a flat toner containing a flat pigment, the developer being accommodated in the developing device; and a transfer device that comprises an intermediate transfer belt onto which the toner image formed on the surface of the image carrier is primarily transferred, a primary transfer device configured to primarily transfer the toner image formed on the surface of the image carrier to a surface of the intermediate transfer belt, and a secondary transfer device configured to secondarily transfer the toner image on the surface of the intermediate transfer belt to a surface of a recording medium, wherein the intermediate transfer belt contains a resin, conductive carbon particles, and a surfactant, and the intermediate transfer belt is configured to have an adhesive force property determined as follows: after the flat toner adheres to an outer circumferential surface of the intermediate transfer belt in a loading amount of 3 g/cm$^2$, under an environment with a temperature of 22° C. and a humidity of 15% when a voltage of 10 kV is applied to the outer circumferential surface, in a case where air is blown from an air blowing port having a diameter of 0.7 mm to the outer circumferential surface from a position 3 cm above an upper side of the outer circumferential surface while increasing a blowing pressure at 0.5 kPa/s, all the flat toner adhering to the outer circumferential surface is separated from the outer circumferential surface at a blowing pressure of 25 kPa or less, wherein the flat toner has an average circle-equivalent diameter that is larger than an average maximum thickness, wherein the flat pigment has an aspect ratio of an average length in a long axis direction to an average length in a thickness direction of 5 or more and 200 or less, and wherein the surfactant includes an oligomer having a silicone structure having a methyl group.

14. The image forming apparatus according to claim 13, wherein a content of the surfactant is 2.5 mass % or more and 12 mass % or less based on a mass of a layer of the intermediate transfer belt containing the surfactant.

* * * * *